US007040955B1

(12) United States Patent
Kalenian et al.

(10) Patent No.: US 7,040,955 B1
(45) Date of Patent: May 9, 2006

(54) CHEMICAL-MECHANICAL PLANARIZATION TOOL FORCE CALIBRATION METHOD AND SYSTEM

(75) Inventors: William Kalenian, San Luis Obispo, CA (US); Thomas A. Walsh, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 11/046,502

(22) Filed: Jan. 28, 2005

(51) Int. Cl.
*B24B 1/00* (2006.01)

(52) U.S. Cl. ..... 451/5; 451/8; 451/9; 451/41; 73/1.15

(58) Field of Classification Search ..... 451/5, 451/41, 8, 9, 63; 73/1.15, 1.08, 865.9; 700/164
See application file for complete search history.

(56) References Cited

U.S. PATENT DOCUMENTS

| | | | | |
|---|---|---|---|---|
| 5,916,009 | A * | 6/1999 | Izumi et al. | 451/5 |
| 6,083,082 | A * | 7/2000 | Saldana | 451/5 |
| 6,241,578 | B1 * | 6/2001 | Togawa et al. | 451/5 |
| 6,315,634 | B1 * | 11/2001 | Jensen et al. | 451/5 |
| 6,766,679 | B1 * | 7/2004 | Judd et al. | 73/1.15 |

* cited by examiner

*Primary Examiner*—George Nguyen
(74) *Attorney, Agent, or Firm*—Marc J. Frechette, Esq.; K. David Crockett, Esq.; Crockett & Crockett

(57) ABSTRACT

The methods and devices described below allow users of CMP tools to quickly calibrate Spindle Force, Wafer Force, and Retaining Ring Force using mechanisms, load cells, a control computer, and force equations. The control computer can test a variety of pressures in the inflatable seal or the inflatable membrane, depending on the wafer carrier configuration, to determine a unique calibration in real time for the particular wafer carrier that is being tested and used during the polishing process.

24 Claims, 9 Drawing Sheets

21
10
1
20
5
5
4
22
2
3
3
2
8
8
9
9
7
6

CHEMICAL-MECHANICAL PLANARIZATION TOOL FORCE CALIBRATION METHOD AND SYSTEM

FIELD OF THE INVENTIONS

The inventions described below relate to the field of workpiece polishing, and more particularly, to methods and devices related to force measurement and calibration in CMP processing of a semiconductor wafer.

BACKGROUND OF THE INVENTIONS

Integrated circuits, including computer chips, are manufactured by building up layers of circuits on the front side of silicon wafers. An extremely high degree of wafer flatness and layer flatness is required during the manufacturing process. Chemical-mechanical planarization (CMP) is a process used during device manufacturing to flatten wafers and the layers built-up on wafers to the necessary degree of flatness.

Chemical-mechanical planarization is a process involving polishing of a wafer with a polishing pad combined with the chemical and physical action of a slurry delivered onto the pad. The wafer is held by a wafer carrier, with the backside of the wafer facing the wafer carrier and the front side of the wafer facing a polishing pad. The polishing pad is held on a platen, which is usually disposed beneath the wafer carrier. Both the wafer carrier and the platen are rotated so that the polishing pad polishes the front side of the wafer. A slurry of selected chemicals and abrasives is delivered onto the pad to affect the desired type and amount of polishing. (CMP is therefore achieved by a combination of chemical softener, physical downward force, and rotation that removes material from the wafer or wafer layer.) The downward force, referred to in this application as the Spindle Force, is split in the wafer carrier to a Retaining Ring Force and a Wafer Force.

Using the CMP process, a thin layer of material is removed from the front side of the wafer or wafer layer. The layer may be a layer of oxide grown or deposited on the wafer, a layer of metal deposited on the wafer, or the wafer itself. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process repeated to build complete integrated circuit chips on the wafer surface.

A variety of wafer carrier configurations are used during CMP. One of these configurations, such as Strasbaugh's Variable-input Pneumatic Retaining Ring (ViPRR) Carrier, is designed to hold the wafer to the carrier inside the boundary of the retaining ring while an inflatable seal situated behind the retaining ring is pressurized. The inflatable ring seal extends the retaining ring into the polish pad generating the Retaining Ring Force. An equation or look-up table is used to determine the amount of air pressure required in the inflatable ring seal to generate a certain amount of force on the ring while the remaining spindle force is exerted against the wafer.

Another configuration of wafer carrier manufactured by Strasbaugh and used in CMP is designed to have the retaining ring fixed to the carrier while an inflatable membrane is used to apply pressure behind the wafer. The inflatable membrane behind the wafer generates the force acting on the wafer called the wafer force. An equation or table is used to determine the amount of air pressure required in the membrane to apply a specified force to the wafer during polishing.

Spindle force on CMP tools is created by the use of a pivoting mechanism coupled to a spindle and actuated by a bellows, piston or other actuator means. Currently, spindle force on CMP tools is calibrated periodically to ensure the spindle force applied during CMP is accurate. A technician uses a load cell fixture to measure spindle forces at various bellows or piston pressures and inputs this information into the controlling computer for calibration. The downward spindle force generated by pressures in a bellows actuation system can change over time, so periodic calibration is required to determine the corresponding spindle force generated by the bellows. The CMP tool must be taken out of service to perform this calibration.

Today, there is no convenient way for measuring spindle force, wafer force, or retaining ring force. Presently, the equation calibrating inflatable seal pressure to ring force or membrane to wafer force, depending on the carrier type, is pre-determined experimentally at the factory using a load cell fixture. Forces are measured for a reasonable sampling of inflatable seals or membranes, depending on the wafer carrier type, at various air pressures. From these experiments, a generic factory equation is calculated and this equation is used for all wafer carriers of that type. As a result, there are many generic equations covering various types and sizes of wafer carriers.

Many problems are encountered using this method of calibration due, in part, to manufacturing inconsistencies between inflatable seals and membranes. Since membranes and inflatable seals are made of a rubber-like material (Such as EPDM, Silicone, HNBR, Buna, etc.) using traditional molding methods, dimensional tolerances are relatively large. In addition to dimensional variations, there can be many differences in the material properties due to composition inconsistencies from seal to seal and membrane to membrane. Also, material properties and dimensions can change over time due to various conditions. Some of these conditions include cycling stresses caused by continuous inflation and deflation, chemical attack by the slurry, heat cycles, and exposure to air and moisture. The dimensional and material properties of the inflatable seals and membranes greatly affect the force calibration curve and changes to these properties can have adverse effects to the calibration curve. Due to the manufacturing inconsistencies, the material inconsistencies, and changes in properties over time, the generic factory force calibrations for wafer carriers are not completely accurate. This can result in sub-optimal and inconsistent polish results.

Previously, semi-conductor designers and manufacturers lived with the inconsistencies in surface flatness, designing their chips around the issues. Other designers and manufacturers required tighter tolerances. These organizations would handle the problems through individual characterization and sorting of the membranes and inflatable seals using a custom bench test machine. This process is slow and labor intensive. Many inflatable seals are deemed un-usable and scrapped because they do not fall within certain predetermined limits. With wafer tolerances becoming more critical methods and devices that are able to quickly characterize and calibrate individual inflatable seals or membranes prior to or in between polishing runs are needed to ensure accurate wafer and retaining ring forces are used in wafer processing.

SUMMARY

The methods and systems described below allow users of CMP tools to easily and accurately calibrate Spindle Force, Wafer Force, and Retaining Ring Force using mechanisms, load cells, a control computer, and force equations. The control computer can test a variety of pressures in the inflatable seal or the inflatable membrane, depending on the wafer carrier configuration, to determine a unique calibration for the particular wafer carrier that is being tested and used during the polishing process. This calibration will be more accurate than the generic factory calibrations because the calibration will be unique to that specific carrier. This system is particularly applicable to wafer carriers having independent retaining ring and wafer force control.

Currently, a calibration would be performed immediately upon installation of a wafer carrier and periodically after a predetermined number of polish cycles to ensure calibration remains accurate throughout the life cycle of the wafer carrier. The present invention allows for calibration to be carried out by a CMP tool prior to or in between a polishing run without taking a machine out of service.

DETAILED DESCRIPTION OF THE INVENTIONS

Figure 1:
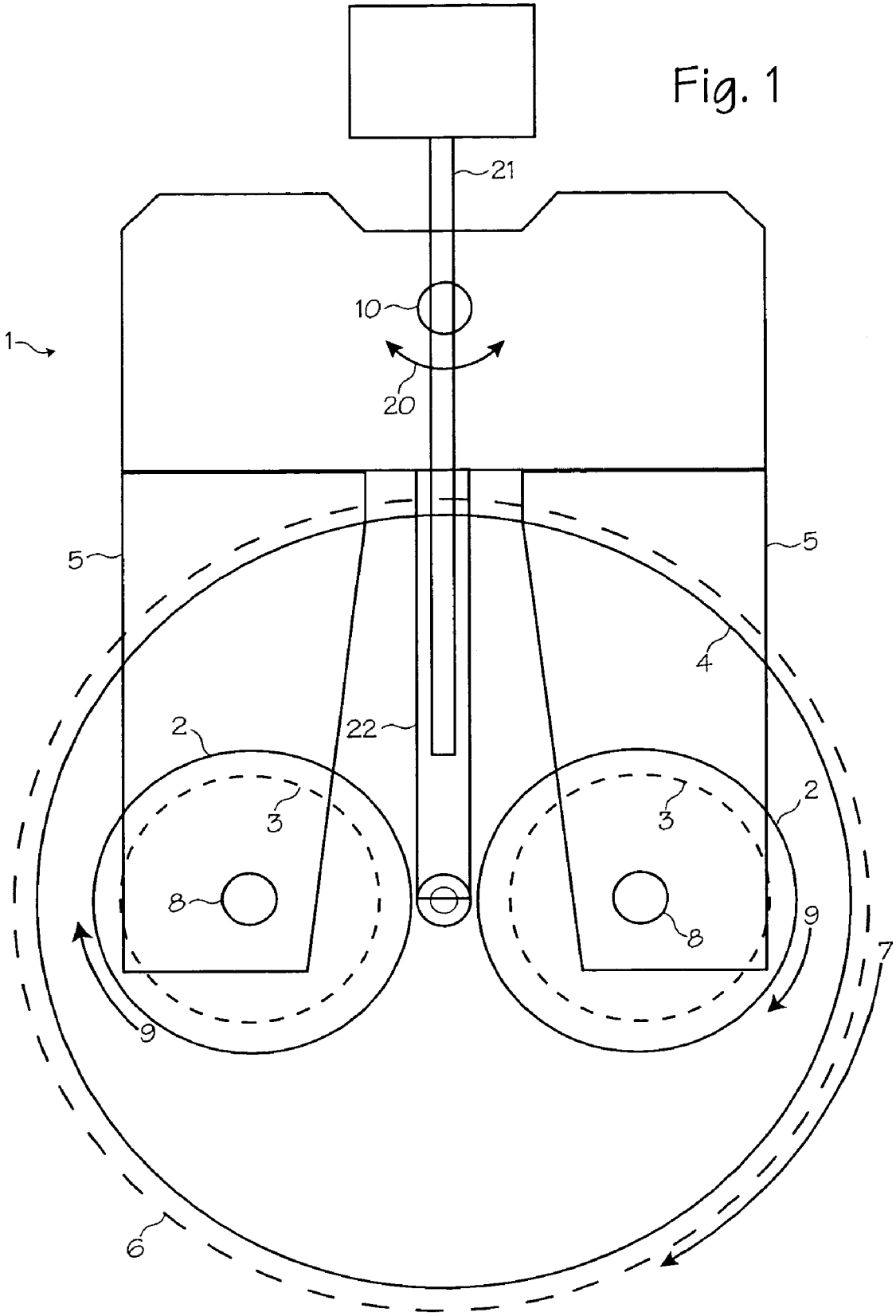
FIG. 1 shows a system for performing chemical mechanical planarization.

FIG. 1 shows a system 1 for performing chemical mechanical planarization (CMP). One or more polishing heads or wafer carriers 2 hold wafers 3 (shown in phantom to indicate their position underneath the wafer carrier) suspended over a polishing pad 4. A wafer carrier 2 thus has a means for securing and holding a wafer 3. The wafer carriers 2 are suspended from translation arms 5. The polishing pad is disposed on a platen 6, which spins in the direction of arrows 7. The wafer carriers 2 rotate about their respective spindles 8 in the direction of arrows 9. The wafer carriers 2 are also translated back and forth over the surface of the polishing pad by the translating spindle 10, which moves as indicated by arrows 20. The slurry used in the polishing process is delivered onto the surface of the polishing pad through slurry injection tube 21, which is disposed on or through a suspension arm 22. (Other chemical mechanical planarization systems may use only one wafer carrier 2 that holds one wafer 3, or may use several wafer carriers 2 that hold several wafers 3. Other systems may also use separate translation arms to hold each carrier.

Figure 2:
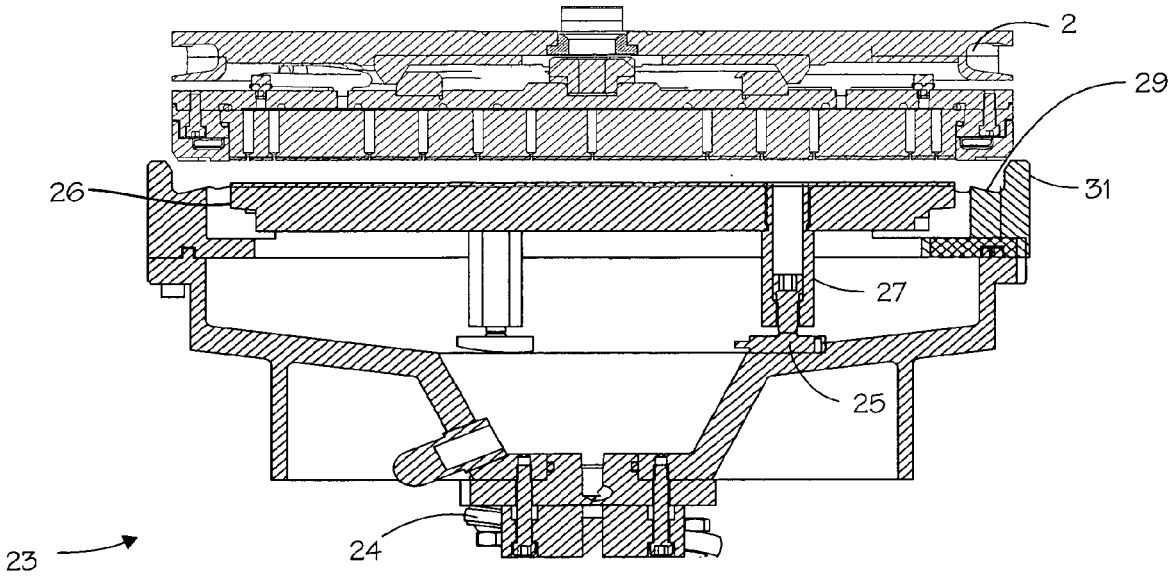
FIG. 2 shows a cross-sectional view of the unloading station incorporating load cells for determining forces applied by components of the wafer carrier and spindle.

FIG. 2 shows a cross-sectional view of an unloading station 23 incorporating load cells for determining forces applied by components of the wafer carrier 2 and spindle 8. A load cell is a transducer that converts a load acting on the load cell into an electrical signal. The unload station 23 of a CMP tool 1 is where a semiconductor wafer 3 is typically unloaded after polishing. In the presently disclosed system, total spindle force and the wafer force component can be measured at the unload station 23. In alternative embodiments of the CMP Tool Force Calibration Method and System, the system can measure the total spindle force and the retaining ring force component or the system can measure the wafer force component, the retaining ring force component, and the total spindle force. Measuring the retaining ring force component, the wafer force component, and the total spindle force component in these alternative embodiments allows the system to calibrate wafer carriers that comprise both independently regulated pressurized membranes and retaining ring seals.

In the CMP Tool Force Calibration system and method, the retaining ring force component is determined by the control computer. The CMP force calibration system may also be incorporated in another part of the CMP tool such as a loading station. To accomplish auto calibration, two Load Cells 24 and 25 are placed within a mechanisms located on the CMP tool 1.

The mechanisms on the unload station are designed to distinguish between total downward force from the spindle 8 and the force acting on the wafer 3. A first load cell 24 measures the total downward force applied by a spindle to a wafer carrier through an actuation system in a CMP tool. A second load cell 25, or plurality of load cells, measures the force component acting on the wafer in a wafer carrier exerted through a back plate or an inflatable membrane; wafer force. A load plate 26 with offsets 27 is placed in the unload station either using a robotic arm or manually. During calibration of the spindle force, pressure in the retaining ring seal or inflatable membrane is set to zero. The wafer carrier is brought down on the mechanism and placed in contact with both a ledge 29 around the inner diameter of unload station's guide ring 31 and the load plate 26 with downward force generated by the actuation system of the spindle. The first load cell 24 measures this downward force and the control computer is able to record these measurements and the corresponding fluid pressure within the bellows of the spindle corresponding to the downward force. The fluid pressure in the bellows is measure by an electro-pneumatic transducer. The resulting force from the bellows acting on the spindle is also measured by beam load cell located in the spindle assembly. Measurements from the beam load cell can be used to calculate spindle force. Measurements from the beam load cell are also compared to measurements from the first load cell 24 found in the unload station by the control computer.

The load plate 26 is further used to transfer downward force acting on the wafer in the wafer carrier to the second load cell 25 located inside the load station. The wafer force component may be generated from a back plate or an inflatable membrane having a membrane pressure. The second load cell 25 is able to measure the wafer force component of the downward force. Force measurements from the spindle 8 and wafer are sent to a control computer. Spindle force, wafer force, and retaining ring force are then appropriately calibrated with corresponding pressures using a Spindle Force Equation ($F_{spindle}=F_{wafer}+F_{retaining\ ring}$).

Figure 3:
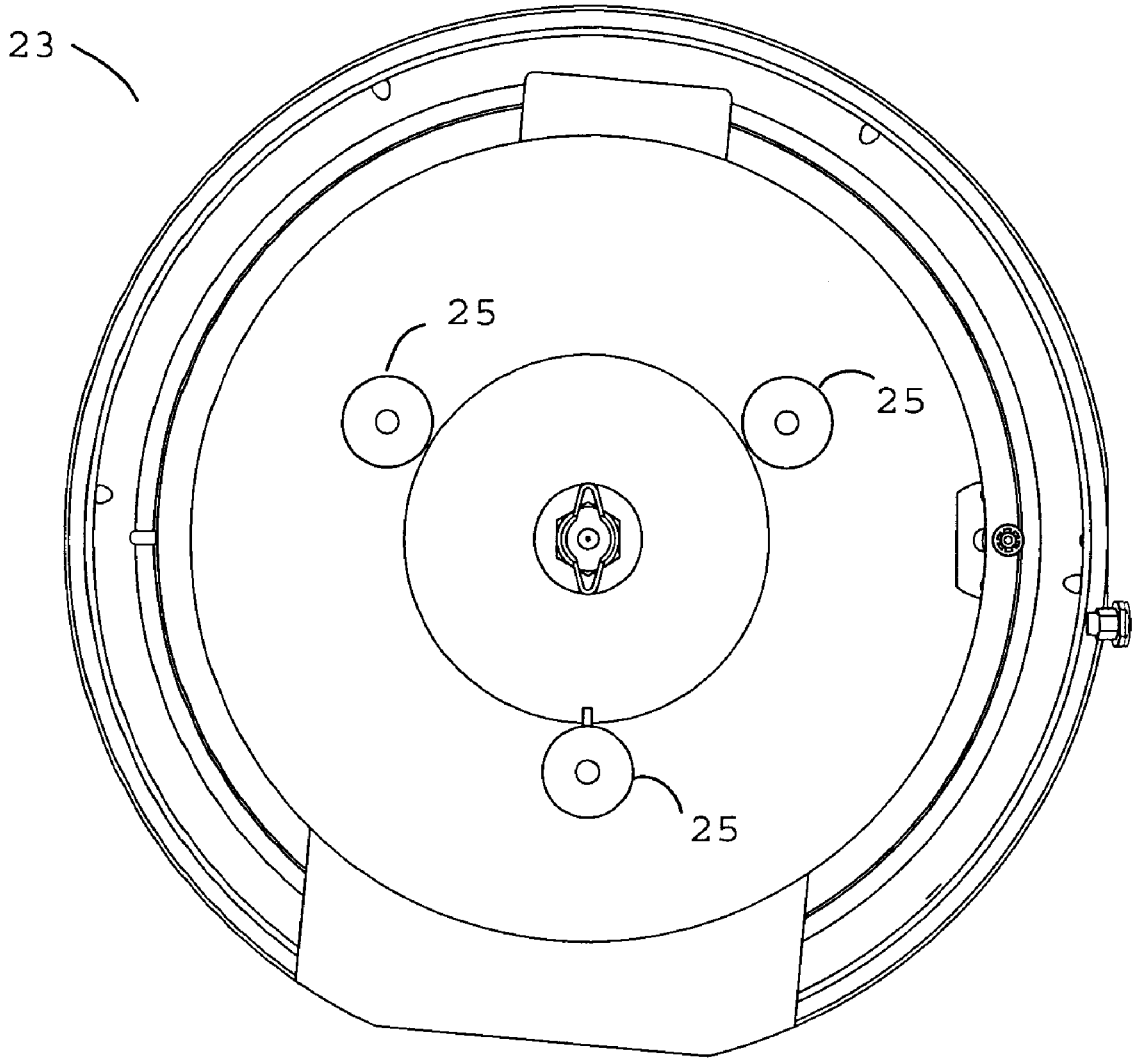
FIG. 3 shows a detailed configuration of a Load Cell in an unloading station.

FIG. 3 depicts a configuration of the mechanism used to measure wafer force in more detail. The load plate 26 is not shown for clarity. The mechanism is comprised of a set of three points positioned approximately 120 degrees from one another with each point containing an individual load cell. All three individual load cells can collectively be used as the second load cell 25 to measure the wafer force component. Alternatively, the mechanism can be configured to have two points as solid supports while the remaining point contain the second load cell 25. Either one of these configurations can be used to measure the wafer force component.

Figure 4:
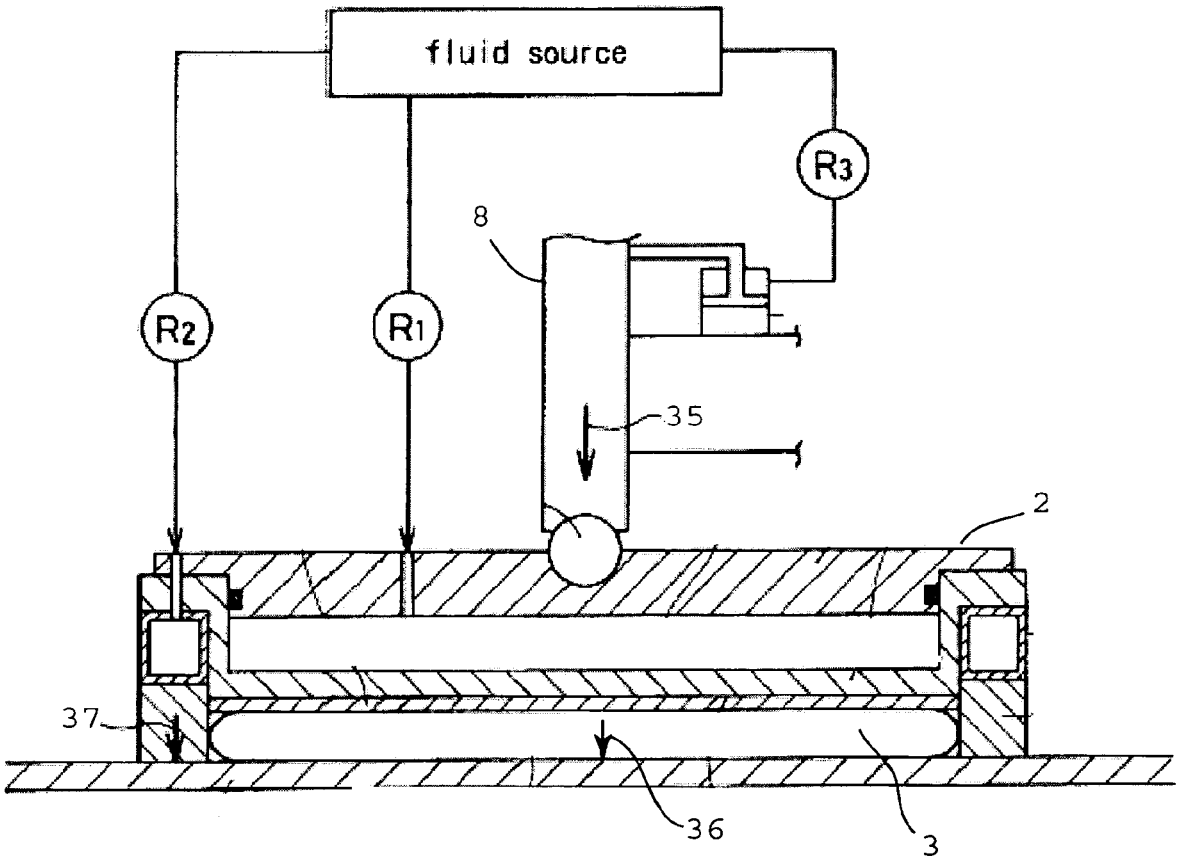
FIG. 4 shows the force equation of Spindle Force, Wafer Force, and Retaining Ring Force as it relates to a spindle, a wafer, and a retaining ring.

FIG. 4 illustrates the three forces considered during CMP polishing. These forces include, spindle force 35, wafer force 36, and retaining ring force 37. Downward force from the spindle 8 acts on the wafer carrier 2 during CMP and the polishing table. The force acting on the wafer carrier 2 is split in the wafer carrier 2 to a retaining ring force 37 component and a wafer force 36 component. The force balance equation of these forces is represented as follows:

$$F_{spindle}=F_{wafer}+F_{retaining\ ring}$$

Where:

$F_{spindle}$=Force from the spindle acting on the wafer carrier $F_{wafer}$=Portion of force from the spindle acting on the Wafer $F_{retaining\ ring}$=Portion of force from the spindle acting on the retaining ring Since Wafer Force 36 plus Retaining Ring Force 37 is equal to the total Spindle Force 35, any of these force values can be calculated by knowing values for two of the three forces in the equation. Using the CMP auto force calibration device, the Spindle Force is set to a desired value. The actual force of the spindle is measured with the first load cell 24. The system also is able to measure wafer force component using the second load cell 25. Retaining ring force can then be calculated by subtracting the wafer force component from the total downward spindle force ($F_{retaining\ ring}=F_{spindle}-F_{wafer}$). Retaining ring force is calculated to generate a calibration curve relating to the retaining ring seal pressure.

Figure 5:
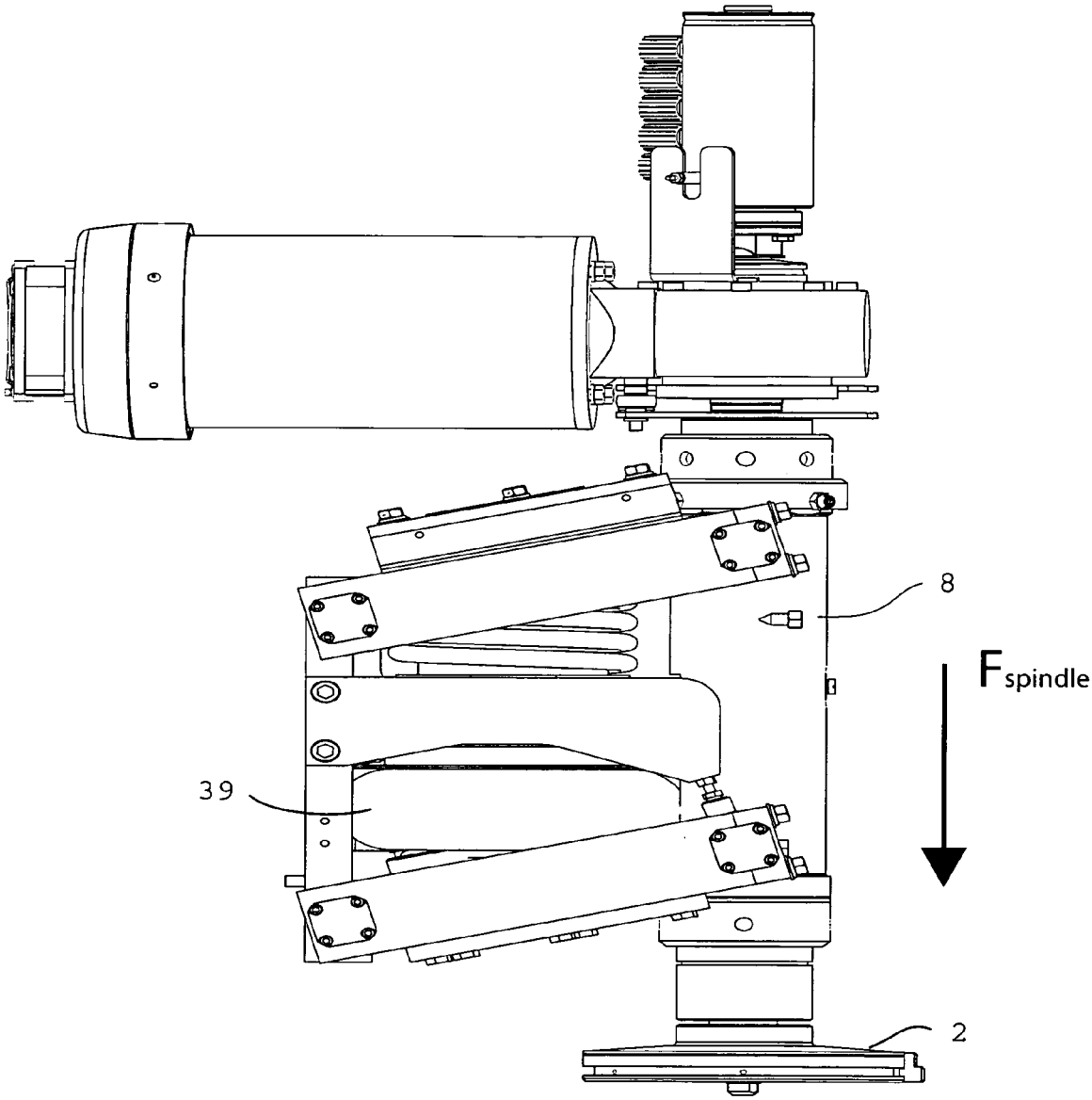
FIG. 5 shows an overarm spindle assembly with bellows actuation.

Spindle force on most CMP tools 1 comes from an actuation system. The actuation system may be pneumatic or hydraulic. Typically, pneumatic actuation of a spindle in a CMP tool is achieved through the use of a bellows 39. FIG. 5 shows an overarm spindle assembly with bellows actuation. The bellows 39 actuate a mechanism that pushes the spindle 8 coupled to a wafer carrier 2 towards a polish pad during CMP. The Spindle Force is divided in the Wafer Carrier into Retaining Ring Force component and Wafer Force component. These two components from the carrier act on the polish table during CMP.

Figure 6:
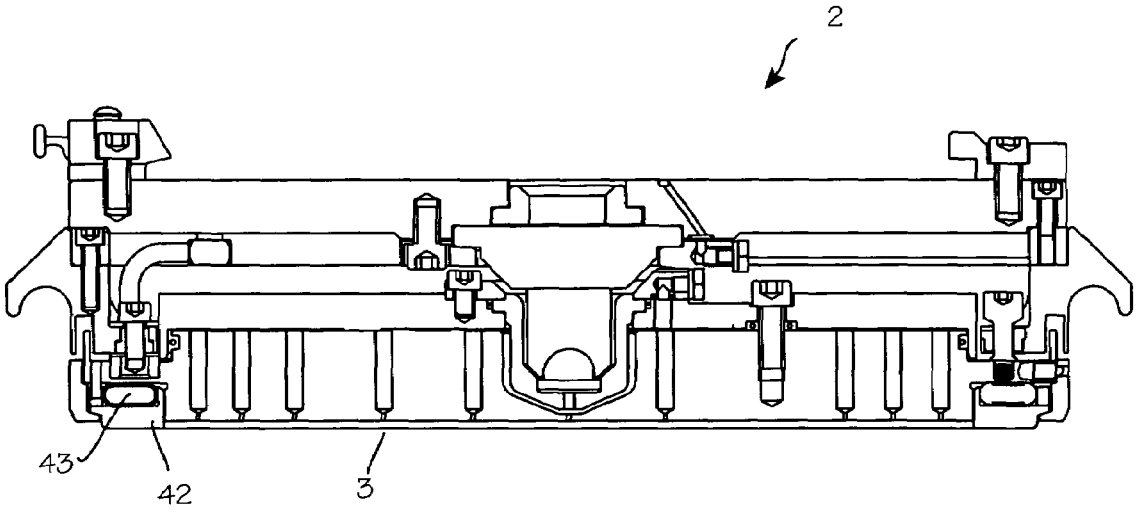
FIG. 6 shows a wafer carrier utilizing an inflatable seal behind a retaining ring.

FIG. 6 shows a wafer carrier 2 utilizing a retaining ring seal 41 behind a retaining ring 42. In some wafer carriers 2, such as Strasbaugh's ViPRR carrier, the semiconductor wafer 3 is held by the carrier 2 while a retaining ring seal 41 situated behind a retaining ring 42 is pressurized. The pressurized retaining ring seal 41 presses against the retaining ring 42. The pressurized retaining ring seal 41 affects the retaining ring force in this type of wafer carrier. An equation or table is used to determine the amount of air pressure required in the inflatable ring seal 41 behind the retaining ring 42 to generate the required amount of force on the retaining ring 42 during CMP. The CMP auto calibration device allows the pressure from the inflatable seal 41 to be calibrated in order to achieve the necessary retaining ring force by taking measurements of the wafer force when the spindle force is set to a known value.

Figure 7:
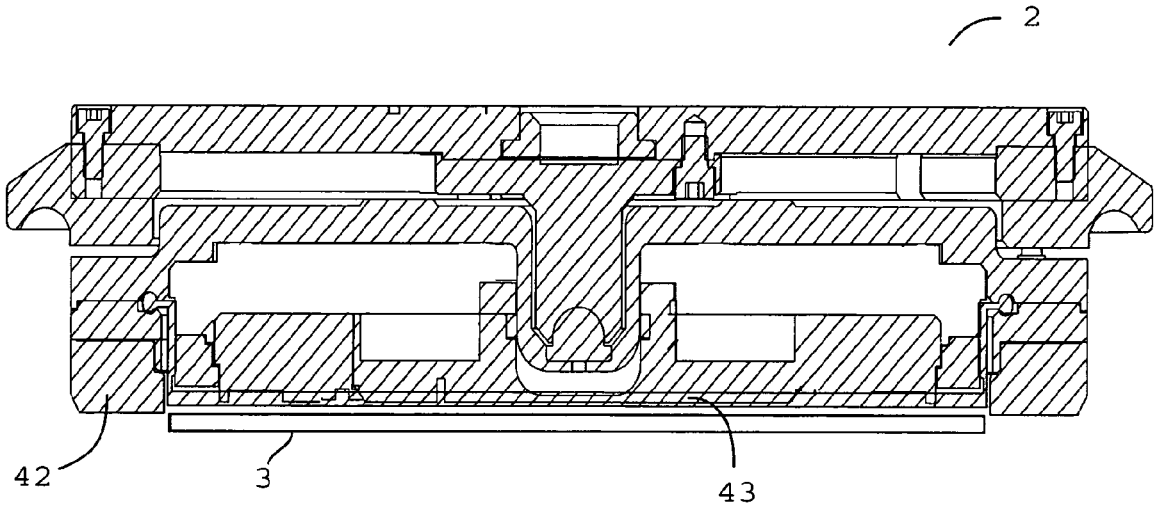
FIG. 7 shows a wafer carrier utilizing an inflatable membrane behind the semiconductor wafer.

In other semiconductor wafer carriers 2 such as the one shown in FIG. 7, the retaining ring 42 is held by the carrier 2, while an inflatable membrane 43 is used to apply pressure behind the wafer 3. The inflatable membrane in this configuration generates a wafer force which is a component of the downward force acting on the wafer. Other wafer carrier configurations may use a back plate to apply a wafer force. An equation or table is used to determine the amount of air pressure required in the membrane 43 to apply a desired force on the wafer 3 during polishing.

Figure 8:
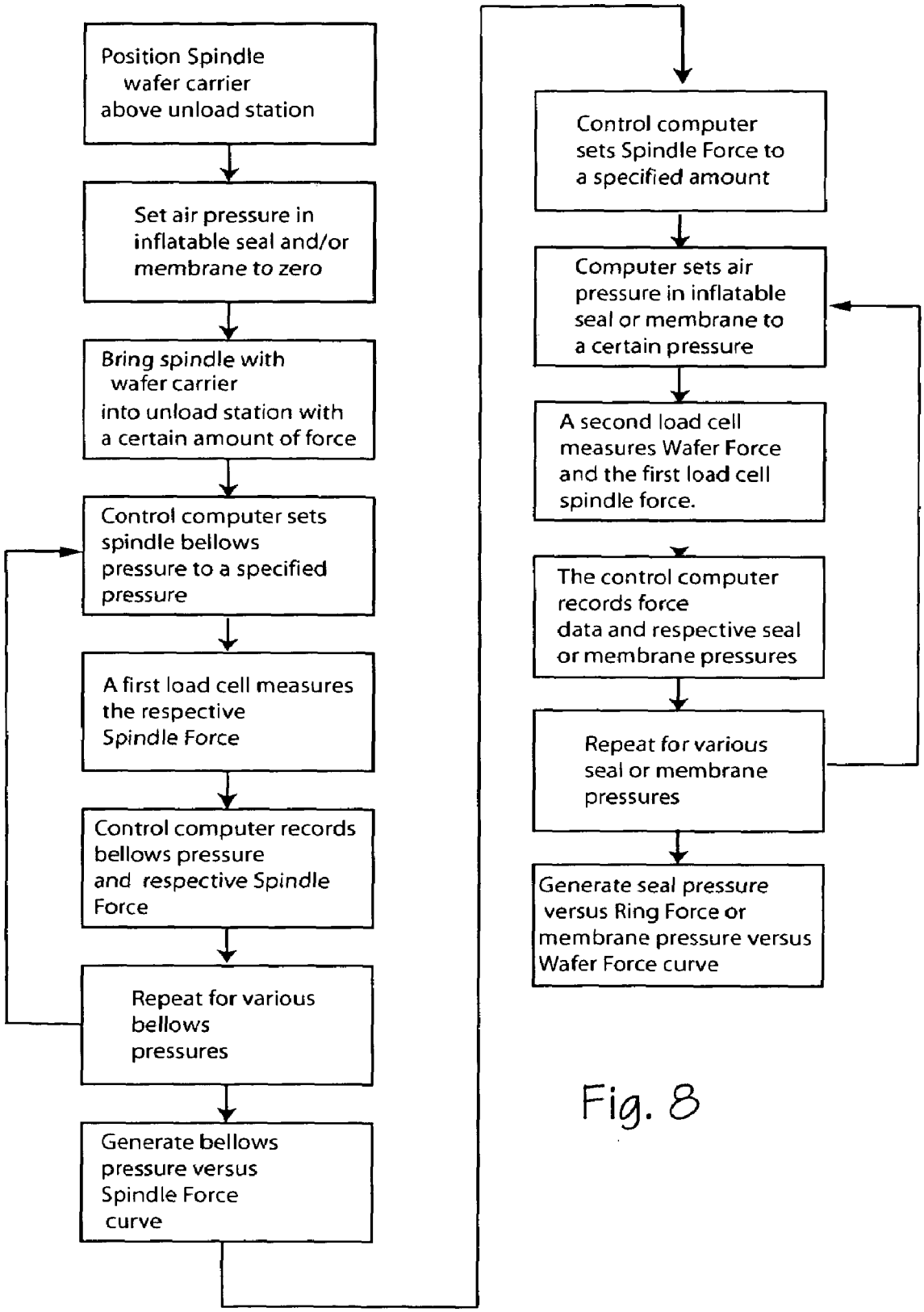
FIG. 8 shows a block diagram of the calibration process.

The CMP calibration system allows a quick and accurate method to calibrate the spindle bellows, inflatable seal, and membrane pressures with corresponding spindle force, retaining ring force, and wafer force in the CMP tool just before or after a polish run. This calibration method and system result in the use of more accurate forces while polishing wafers. FIG. 8 shows a block diagram of the auto calibration method. When the CMP auto calibration device is in use, a load plate 26 with offsets 27 is placed in the unload station 23. Placement of the load plate 26 is accomplished by an operator or a robot arm coupled to the CMP tool. The offsets 27 in the load plate 26 are situated above a load cell or plurality of load cells located in the unload station 23. The offset 27 can be adjustable and the height of the load plate 26 can be adjusted to compensate for wafer 3 thickness. Next, pressure in the retaining ring seal 41 or inflatable membrane 43 is set to zero, depending on the carrier type. This way, a spindle force measurement unaffected by ring seal pressure or membrane pressure can be taken. A Spindle 8 with a wafer carrier 2 is then positioned above an unload station 23 in a CMP tool 1. The wafer carrier 2 can be loaded with a test wafer or alternatively, the wafer carrier 2 can be empty depending on the configuration of the load plate 26. Once positioned above the unload station 23, the actuation system of the spindle is pressurized and the wafer carrier 2 is brought down onto the unload station 23 with a certain amount of downward force. The unload station has some degree of freedom horizontally in the x and y direction and its configuration is such that it is self-centering with the spindle and carrier. This enables the carrier to align itself with the center of the unload station. When the wafer carrier is brought down onto the unload station, it is placed in contact with the load plate 26 and ledge 29 around the guide ring in the unload station.

Figure 9:
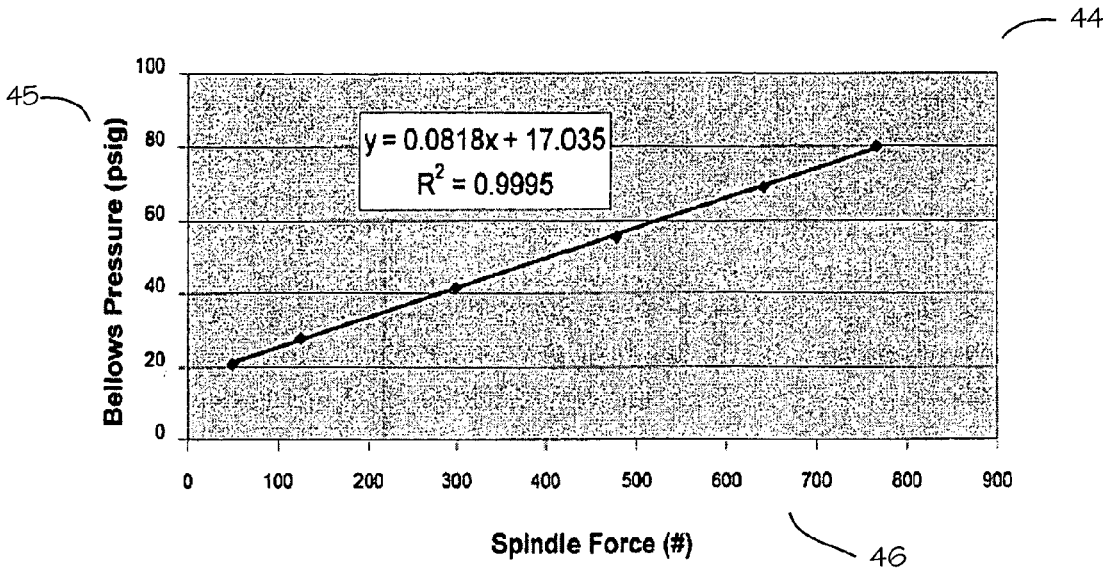
FIG. 9 shows a Spindle Calibration Curve.

To calibrate the spindle force, a control computer commands the actuation system to a specified pressure creating the downward force of the spindle. Pressure in the wafer carrier's inflatable ring seal or inflatable membrane is at zero. The actuation system brings the wafer carrier down to the unload station and the first load cell 24 is then used to measure the resulting spindle force created by the actuation system. The control computer records the measurements from the first load cell 24 and the respective bellows pressure that generated that spindle force. The control computer then repeats this process for various pressures in the actuation system and records the pressures and corresponding spindle force. As FIG. 9 illustrates, a spindle calibration curve 44 is created using the data collected for bellows pressure 45 or piston pressure versus Spindle Force 46.

Figure 10:
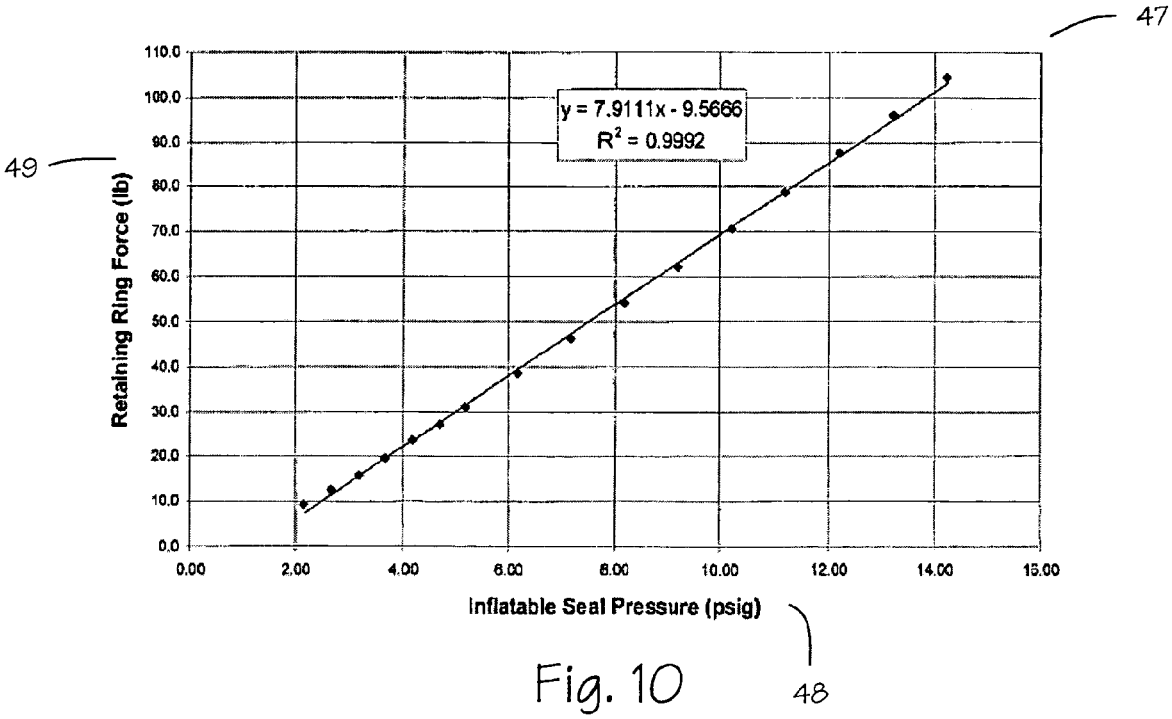
FIG. 10 shows a Carrier Calibration Curve.

To calibrate fluid pressure corresponding to force components in the wafer carrier 2 such as retaining ring force or wafer force, the control computer first commands the spindle force to a specified amount bringing the wafer carrier down onto the unload station. The control computer then sends a command to inflate the retaining ring seal 41 or to inflate the inflatable membrane 43, depending on the carrier 2 configuration, to a certain amount of pressure. The first load cell 24 is then used to measure the total amount of spindle force. The second load cell 25 is used to measure the wafer force component of the spindle force. The control computer tests and records force data for a variety of ring seal or membrane pressures. The control computer using the total spindle force and wafer force components calculates the retaining ring force. As shown in FIG. 10, the control computer, using the spindle force equation, uses the data and values collected to generate a calibration curve 47 that corresponds either to the inflatable ring seal pressure 48 that generates a retaining ring force 49 or the inflatable membrane pressure that generates a corresponding wafer force. The resulting calibration curve 47 is dependent on the type of wafer carrier 2 configuration. FIG. 10 shows a calibration curve 47 for a VIPRR wafer carrier 2 having an inflatable ring seal.

The calibration curves 44 and 47 generated by the above procedure are unique to the tested wafer carrier 2 and spindle. The calibrated spindle and carrier can then be used during the wafer polishing process. The unique calibration ensures the Spindle Force, wafer force, and Retaining ring forces are correct during CMP.

Calibration should occur when needed. It can be performed when a carrier 2 is replaced with a different carrier 2, when the retaining ring 42 and/or retaining ring seal 41 are replaced, or when heights of carriers 2 are adjusted (retaining ring height is set using shims—as the ring wears, the height must be shimmed-up). Wafer carriers 2 have many consumable items (including retaining rings 42 and retaining ring seals 41) requiring periodic servicing. As such, it is common for the carriers to be removed, rebuilt, and replaced periodically. Calibration should be performed after rebuilding the carrier 2. If the wafer carrier is changed in the CMP tool, the calibration process should also be repeated for that new carrier 2. In addition, calibrations tend to drift over time. Periodic calibrations should occur even if carriers 2 are not changed or rebuilt. The presently disclosed system and method allows for a convenient and accurate calibration of spindles and wafer carriers found in a CMP tool.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A system for calibrating a CMP tool comprising:

a CMP tool;

a first mechanism disposed in the CMP tool capable of measuring a downward force of a spindle generated by an actuation system;

a second mechanism in said CMP tool capable of measuring a wafer force component of said downward force; and a control computer programmed to:

control, measure, and record the downward force of the spindle generated by the actuation system;

measure and record the wafer force component of said downward force;

determine a retaining ring force component of said downward force.

2. The system of claimed 1 wherein said mechanism comprises a first load cell able to measure the downward force of the spindle.

3. The system of claim 1 wherein the second mechanism comprises a second load cell able to measure the wafer force component of the downward force.

4. The system of claim 1 wherein the second mechanism comprises a plurality of load cells able to measure the wafer force component of the downward force.

5. The system of claim 1 wherein the second mechanism comprises two supports and the second load cell.

6. The system of claim 1 wherein said actuation system comprises a bellows.

7. The system of claim 6 wherein the actuation system further comprises a bellows pressure generating the downward force and the control computer is further programmed to:

measure the bellows pressure corresponding to the downward force;

record the bellows pressure corresponding to the downward force; and generate a calibration table corresponding bellows pressure to downward force.

8. The system of claim 1 or claim 7 wherein the control computer is further programmed to control the wafer force component of the downward force.

9. The device of claim 8 wherein the wafer force component is generated in a wafer carrier by a back plate or inflatable membrane having an inflatable membrane pressure.

10. The system of claim 9 wherein said control computer is further programmed to create a table corresponding the wafer force component to the inflatable membrane pressure generating the wafer force component.

11. The system of claim 1 or claim 7 wherein said control computer is further programmed to control the retaining ring force component.

12. The system of claim 11 wherein the retaining ring force component is generated by an inflatable retaining ring seal having a ring seal pressure in a wafer carrier.

13. The system of claim 12 wherein said control computer is further programmed to create a table corresponding the retaining ring force component to the respective ring seal pressure generating the retaining ring force component.

14. A method for calibrating a CMP comprising:

positioning a spindle with a wafer carrier above a mechanism able to measure a downward force of the spindle generated by an actuation system and able to measure a wafer force component of said downward force;

bringing said wafer carrier onto the mechanism with an amount of downward force; and calibrating the actuation system to the downward force.

15. The method of claim 14 further comprising calibrating the wafer force component of the downward force.

16. The method of claim 14 or claim 15 further comprising calibrating a retaining ring force component of the downward force.

17. The method of claim 14 wherein said step of calibrating the downward force further comprises pressurizing a spindle bellows in the actuation system with a bellows pressure, measuring the downward force with a first load cell in the mechanism, recording the downward force, and recording the bellows pressure corresponding to the downward force.

18. The method of claim 17 further comprising comparing the bellows pressure to the downward force and generating a spindle calibration curve.

19. The method of claim 15 wherein the step of calibrating a wafer force further comprises setting said spindle force to a known amount of force and pressurizing an inflatable membrane behind a wafer with a membrane pressure generating the wafer force component.

20. The method of claim 19 further comprising measuring said spindle force with the first load cell, measuring the wafer force with a second load cell, and recording the wafer force component and said membrane pressure.

21. The method of claim 20 further comprising comparing the membrane pressure with the wafer force component and generating a calibration curve.

22. The method of claim 17 wherein said step of calibrating a retaining ring force further comprises setting said spindle force to a known force, pressurizing a retaining ring seal behind a retaining ring with an ring seal pressure generating a retaining ring force.

23. The method of claim 22 further comprising measuring the downward force with the first load cell, measuring the wafer force component with the second load cell, determining the retaining ring force component, and recording the retaining ring force component and the corresponding ring seal pressure.

24. The method of claim 23 further comprising comparing said ring seal pressure with said retaining ring force component and generating a calibration curve.

* * * * *